US005848883A

United States Patent [19]

Tsubokawa

[11] Patent Number: 5,848,883

[45] Date of Patent: Dec. 15, 1998

[54] SCROLL COMPRESSOR HAVING A BACK PRESSURE PARTITIONING MEMBER

[75] Inventor: Masahiro Tsubokawa, Kusatsu, Japan

[73] Assignee: Matsushita Electric Industrial Co., Ltd.

[21] Appl. No.: 804,844

[22] Filed: Feb. 24, 1997

[51] Int. Cl.[6] ..... F04C 18/04; F04C 27/00

[52] U.S. Cl. ..... 418/55.4; 418/55.5; 418/57

[58] Field of Search ..... 418/55.4, 55.5, 418/57

[56] References Cited

U.S. PATENT DOCUMENTS 5,085,565 2/1992 Barito ..... 418/55.4

FOREIGN PATENT DOCUMENTS 63-106386 5/1988 Japan ..... 418/55.5

1-178785 7/1989 Japan .

3-149382 6/1991 Japan ..... 418/55.4

3-160177 7/1991 Japan ..... 418/55.4

*Primary Examiner*—John J. Vrablik

*Attorney, Agent, or Firm*—Stevens, Davis, Miller & Mosher, L.L.P.

[57] ABSTRACT

A scroll compressor is designed to exert a stable pressure on the rear surface of the rotary scroll without causing excessive pressure rise or pressure gradient by the lubricating oil which flows out from a back pressure partitioning member in a very little gap of an axial supporting portion. A bearing member 18 has an inner portion extending radially inwardly from annular groove 22 and an outer portion extending radially outwardly from the annular groove 22 to an inner edge of an axial supporting portion 24. The inner and outer portions of the bearing member 18 are formed in a bottom portion of the bearing member 18 and have a difference in level d relative to a bottom surface of the axial supporting portion 24.

4 Claims, 3 Drawing Sheets

SCROLL COMPRESSOR HAVING A BACK PRESSURE PARTITIONING MEMBER

BACKGROUND OF THE INVENTION

The present invention relates to a scroll compressor.

A known scroll compressor is arranged such that, as shown in JP-A-1-178785, for example, very little gap 19 between a rotary end plate 11 and an axial supporting portion 24 of a bearing member with which the rear surface of the rotary end plate 11 is brought into slidable contact is partitioned by a back pressure partitioning member 21 so as to exert the discharge pressure of a compressing mechanism on the central side of the rear surface of the aforementioned rotary end plate 11, and also exert a proper pressure between the discharge pressure and the suction pressure on the outside of the rear surface in order to relieve the axial thrust force added by a compressing operational space to the rotary end plate 11 of the rotary scroll as shown in FIG. 4. And, the back pressure partitioning member 21 is urged against the rear surface of the rotary end plate 11 by virtue of the flow of the lubricating oil having a pressure which equals to the discharge pressure of the compressing mechanism exerted on the central side of the rear surface of the rotary end plate 11 into an annular groove 22 formed in the bearing member for housing the back pressure partitioning member 21.

In the above-mentioned prior art, the lubricating oil which flowed into the annular groove 22 will flow partially into the gap 19 between the aforementioned rotary end plate 11 located outside of the aforementioned back pressure partitioning member 21 and the aforementioned axial supporting portion 24, thereby developing a pressure gradient on the rear surface of the aforementioned rotary end plate 11. The pressure gradient occurs when a great deal of lubricating oil is outflowed, as a result, the force pushing the rotary end plate 11 becoming excessive, thereby increasing the power losses due to sliding movement on the plane of the rotary end plate 11 thus bringing about a lowering of the efficiency of the compressor.

SUMMARY OF THE INVENTION

The present invention has been devised to solve the above-mentioned problem contingent to the prior art, and has for its object to exert the discharge pressure of the compressing mechanism on the central side of the rear surface of the rotary end plate, and exert a proper pressure, which is lower than the discharge pressure, on the outside of the rear surface, thereby achieving safe operation of the compressor, thus preventing the lubricating oil which flowed out of the back pressure partitioning member from developing an excessive pressure rise or pressure gradient in the axial supporting portion of the bearing member.

To solve the above-mentioned problem, according to the present invention, a scroll compressor comprises a stationary scroll formed on a stationary framework; a rotary scroll which engages with the stationary scroll to define a plurality of compression spaces; an Oldham's coupling (slider coupling) adapted to prevent the rotary scroll from turning on its own axis; a crankshaft adapted to rotate or drive the rotary scroll eccentrically; and a bearing member including a main bearing supporting one end of this crankshaft, the peripheral plane of said stationary framework is brought into contact with that of the rotary or gyrating end plate of said rotary scroll, said bearing member is provided with an axial supporting portion with a very little gap spaced relative to the rear surface of said rotary end plate, and a back pressure partitioning member adapted to slidably seal and partition said gap is accommodated in an annular groove formed in said bearing member in such a manner that the discharge pressure of the compressing mechanism is exerted on the central side of the rear surface of said rotary end plate and a pressure lower than the discharge pressure is exerted on the outside of the rear surface, a portion of the inside and outside, respectively, of said annular groove having a difference in level relative to said axial supporting portion.

Due to the above-mentioned arrangement, the back pressure partitioning member is urged against the rear surface of the rotary end plate by virtue of the flow of the lubricating oil having a pressure which equals to the discharge pressure of the compressing mechanism exerted on the central side of the rear surface of the rotary end plate into an annular groove formed in a bearing member housing the back pressure partitioning member, while at the same time a part of the lubricating oil which flowed out from the back pressure partitioning member does not cause any fluid resistance at the portion having a difference in level where the gap of the axial supporting portion is enlarged in size, so that no pressure gradient is developed, and therefore a stable pressure can be exerted on the rear surface of the rotary end plate.

The above-mentioned and other objects, aspects and advantage of the present invention will become apparent to those skilled in the art by making reference to the following description and the accompanying drawings in which preferred embodiment incorporating the principles of the present invention is shown by way of example only.

DESCRIPTION OF THE PREFERRED EMBODIMENT

Figure 1:
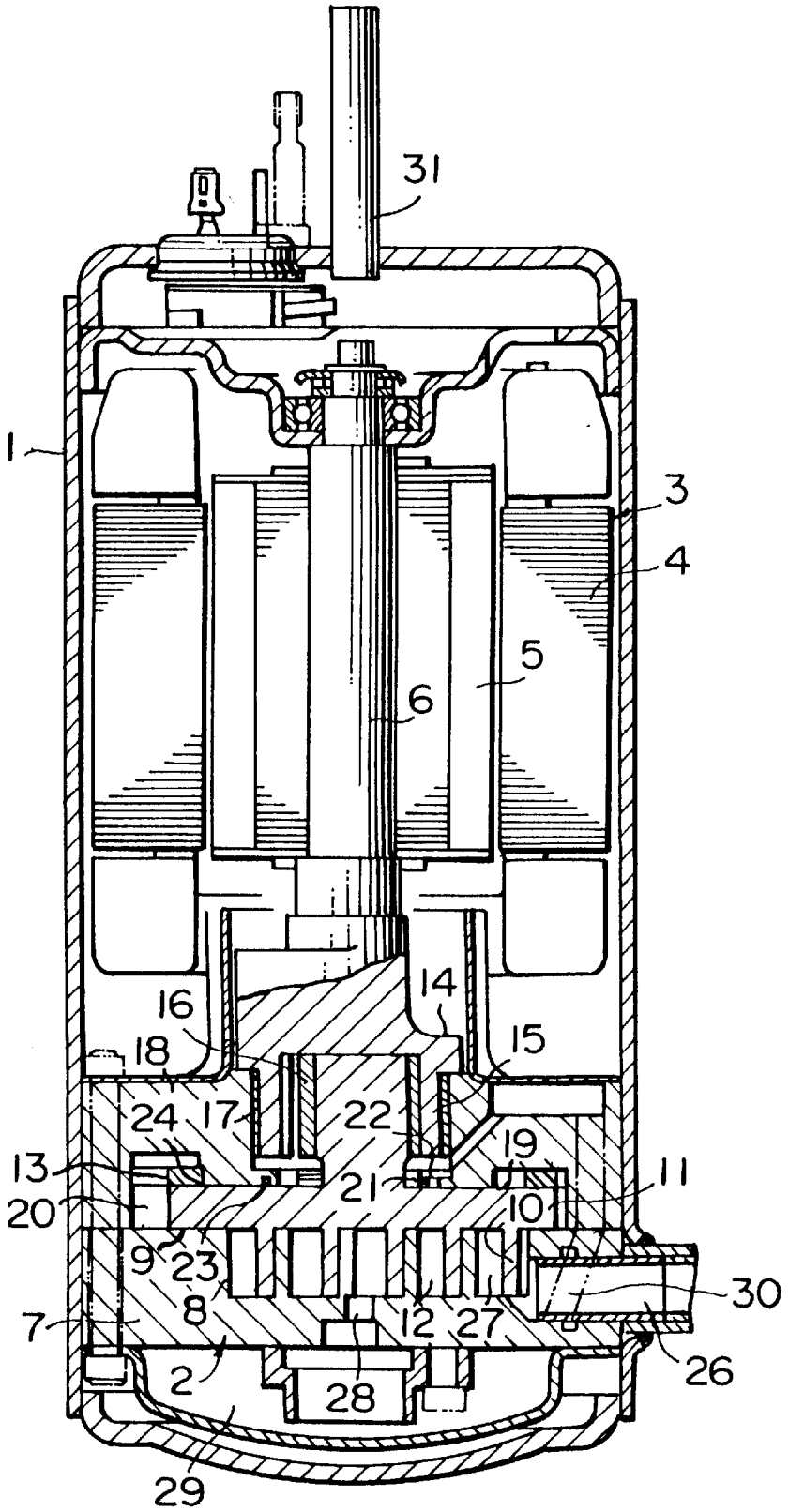
FIG. 1 is a longitudinal sectional view of a compressor according to one exemplary embodiment of the present invention.
Figure 2:
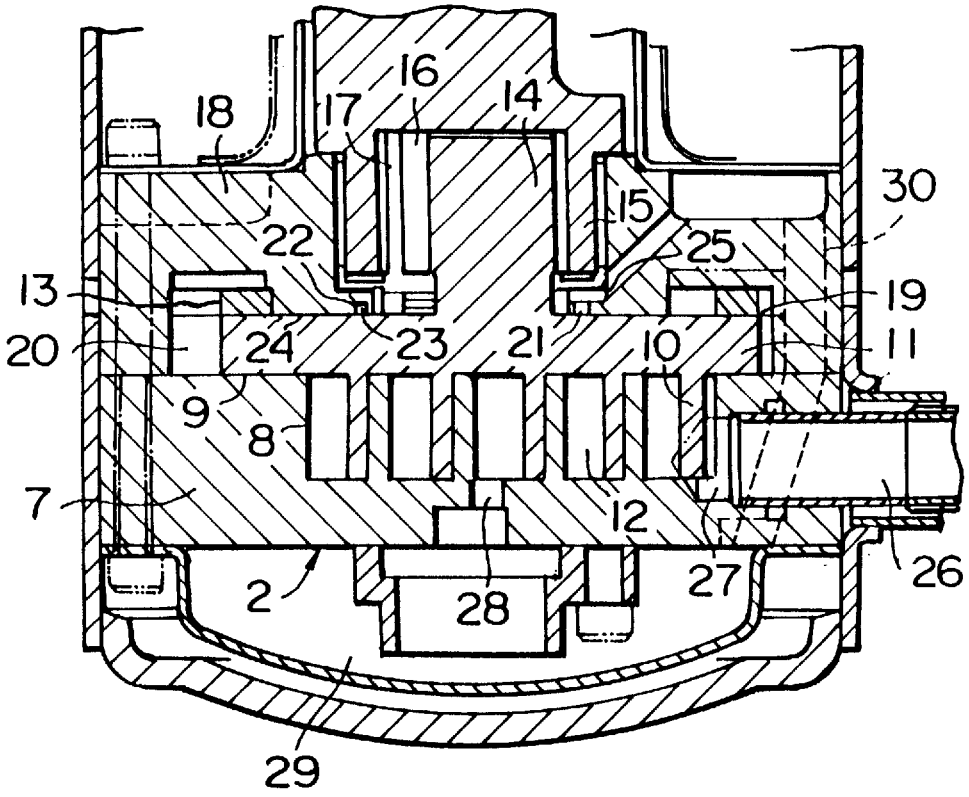
FIG. 2 is a longitudinal sectional view of the compressing mechanism portion of the compressor.
Figure 3:
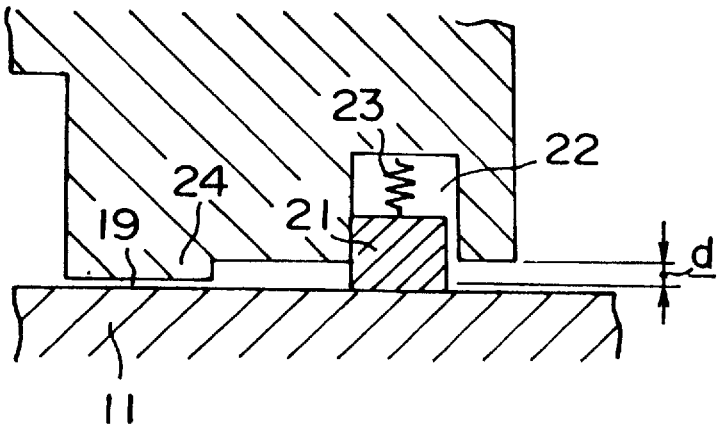
FIG. 3 is a longitudinal sectional view of the portion in the vicinity of a back pressure partitioning member of the compressing mechanism.
Figure 4:
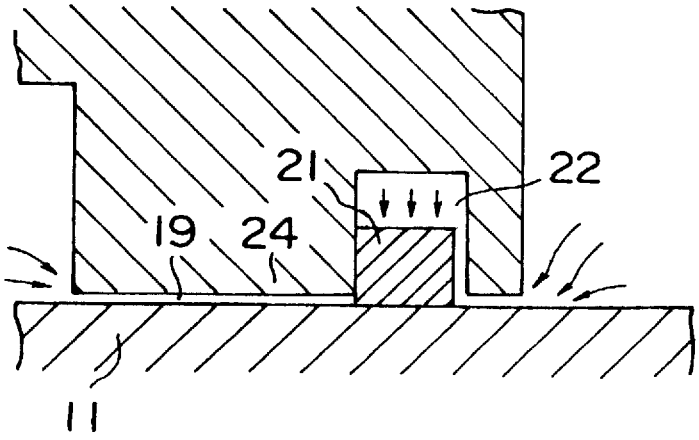
FIG. 4 PRIOR ART
FIG. 4 is a longitudinal sectional view of a prior art back pressure partitioning member.

The present invention will now be described in detail below by way of example only with reference to the accompanying drawings. FIG. 1 shows a longitudinal sectional view of a scroll compressor according to one exemplary embodiment of the present invention. FIG. 2 shows an enlarged view of a compressing mechanism of the compressor. A stator 4 of an electric motor 3 adapted to drive the compressing mechanism 2 is fixedly secured to the interior of a hermetically sealed container 1, and a rotor 5 of the motor 3 is coupled with a crankshaft 6 for driving the compressing mechanism 2. The compressing mechanism 2 includes a stationary scroll 8 formed on a stationary framework 7, a rotary scroll 9 having a rotary scroll vane 10 which meshes with the stationary scroll 8 to thereby form a plurality of compressing operational spaces 12 and which are formed on a rotary end plate 11, and an Oldham's coupling 13 adapted to prevent this rotary scroll 9 from turning on its own axis and permit only gyration of the same, a rotary driving shaft 14 provided on the opposite side of the rotary scroll vane 10 of the aforementioned rotary end plate 11 is inserted in an eccentric shaft 16 provided inwardly of a main shaft 15 formed on one end of the crankshaft 6, the crankshaft 6 being supported by a bearing member 18 having a main bearing 17 supporting the main shaft 15. Further, provided on the rear surface of the aforementioned rotary end plate 11 is a ring-shaped back pressure partitioning member 21 which is slidable on the rear surface of the end plate 11 and which serves to partition the extremely small gap 19 in such a way that the discharge pressure from the compressing mechanism 2 is exerted on the central side of the rear surface of the rotary end plate 11, and a proper intermediate pressure between the discharge pressure and the suction pressure is exerted in a back pressure chamber 20 formed on the outside thereof. And also, a spring member 23 adapted to push the back pressure partitioning member 21 against the rear surface of the above-mentioned rotary end plate 11 is provided on the back of the partitioning member. The back pressure partitioning member 21 and the spring member 23 are accommodated in an annular groove 22 formed in the bearing member 18. As shown in FIG.3, an inner portion extending radially inwardly from the annular groove 22 and an outer portion extending radially outwardly from the annular groove 22 are formed in a bottom portion of the bearing member 18 and have a difference in level relative to a bottom surface of the axial supporting portion 24. Further, the pressure in the back pressure chamber 20 depends on fine or minute holes or gaps, etc., which communicate with the back pressure chamber 20. A refrigerant taken in through a suction pipe 26 of the compressor will enter the compressing mechanism 2 through a suction port 27, and will be compressed by the compressing operational spaces 12 and enter the discharge space provided in the lower portion of the compressing mechanism 2 through a discharge port 28, and via a discharge communicating hole 30 which extends through the outer peripheral portions of the stationary framework 7 and the bearing member 18, and through the space within the hermetically sealed container 1 and will be discharged through a discharge pipe 31 out of the compressor. The operation of one embodiment of the present invention will be described subsequently. The refrigerant taken in through the suction port 27 is compressed in turn by the compressing spaces 12 and is then discharged from the discharge port 28. At that time, the rotary end plate 11 of the rotary scroll 9 is subjected to an axial thrust force developed or added by the compressing operational spaces 12 so that the rear surface of the rotary end plate 11 tends to be pushed against the axial supporting portion 24 of the bearing member 18. However, by providing a difference d in level to the inner and outer portions extending radially inwardly and outwardly, respectively, from the annular groove 22 formed in the bearing member 18 and in which the back pressure partitioning member 21 and the spring member 23 are accommodated, relative to the axial supporting portion 24, as shown in FIG. 3, the rear surface of the rotary end plate 11 is partitioned by the back pressure partitioning member 21, so that the discharge pressure of the compressing mechanism 2 is exerted on the central side of the rear surface of the rotary end plate, whilst a proper intermediate pressure between the discharge pressure and the suction pressure is exerted to the outside of the aforementioned rear surface. At that time, even if a great deal of lubricating oil leaks out from the back pressure partitioning member 21, since the gap which is enlarged in size extends up to the portion having a difference in level, it does not cause any fluid resistance, so that no pressure gradient is developed. Consequently, the axial thrust force developed or added by the abovementioned compressing operational spaces 12 is relieved so that the power losses caused by sliding movement of the bearing member 18 on the axial supporting portion 24 is reduced, while it becomes possible to prevent the lubricating oil which flowed out from the back pressure partitioning member 21 from developing pressure rise or pressure gradient, thus rendering it possible to prevent increase in the power losses.

Further, it will be readily understood that the same effect can be obtained even if the pressure acting on the outside of the back pressure partitioning member 21 is the suction pressure.

According to the present invention described hereinabove, since the lubricating oil which flowed out from the back pressure partitioning member dose not cause any abnormal pressure rise or pressure gradient in the back pressure, stable back pressure can be exerted so that improvement and stabilization of the efficiency of the compressor can be realized.

What is claimed is:

1. A scroll compressor comprising:

a first scroll formed on a framework, the framework having a peripheral plane;

a second scroll which engages with the first scroll to define a plurality of compression spaces, the second scroll having an end plate with a peripheral plane and a rear surface;

an Oldham's coupling for preventing the second scroll from turning on its own axis;

a crankshaft for rotating or driving the second scroll eccentrically; and a bearing member including a main bearing supporting one end of the crankshaft; wherein:

the peripheral plane of said framework is slidably brought into contact with the peripheral plane of the end plate of said second scroll, while said bearing member is provided with an axial supporting portion with a very little gap relative to the rear surface of said end plate, and a back pressure partitioning member adapted to slidably seal and partition said gap is accommodated in an annular groove formed in said bearing member in such a manner that a discharge pressure of the scroll compressor is exerted on a central side of the rear surface of said end plate and a pressure lower than the discharge pressure is exerted on an outside of the rear surface, and said bearing member having an inner portion extending radially inwardly from said annular groove and an outer portion extending radially outwardly from said annular groove to an inner edge of said axial supporting portion, said inner and outer portions of said bearing member being formed in a bottom portion of the bearing member and having a difference in level relative to a bottom surface of said axial supporting portion.

2. A scroll compressor as claimed in claim 1, wherein a suction pressure is exerted on the outside of the rear surface of the rotary and plate.

3. A scroll compressor as claimed in claim 1, wherein:

the first scroll is a stationary scroll;

the framework is a stationary framework; and the second scroll is a rotary scroll.

4. A scroll compressor as claimed in claim 1, further comprising a biasing means for biasing the back pressure partitioning member outward from the annular groove.

* * * * *